US005524710A

United States Patent [19]

Shinn

[11] Patent Number: 5,524,710

[45] Date of Patent: Jun. 11, 1996

[54] HANGER ASSEMBLY

[75] Inventor: Terry L. Shinn, Houston, Tex.

[73] Assignee: Cooper Cameron Corporation, Houston, Tex.

[21] Appl. No.: 360,410

[22] Filed: Dec. 21, 1994

[51] Int. Cl.[6] ..... E21B 29/12; E21B 23/02

[52] U.S. Cl. ..... 166/348; 166/382; 166/85.5; 166/88.4

[58] Field of Search ..... 166/85, 88, 348, 166/360, 382

[56] References Cited

U.S. PATENT DOCUMENTS

| | | | |
|---|---|---|---|
| 4,077,472 | 3/1978 | Gano | 166/382 |
| 4,133,378 | 1/1979 | Gano | 166/85 |
| 4,154,298 | 5/1979 | Gano | 166/85 |
| 4,284,142 | 8/1981 | Kirkland | 166/85 X |
| 4,556,224 | 12/1985 | Le | 277/118 |
| 4,562,889 | 1/1986 | Braddick | 166/381 |
| 4,653,589 | 3/1987 | Alandy | 166/208 |
| 4,794,988 | 1/1989 | van Bilderbeek | 166/345 |
| 4,807,705 | 2/1989 | Henderson et al. | 166/348 |
| 4,823,871 | 4/1989 | McEver et al. | 166/182 |
| 4,938,289 | 7/1990 | van Bilderbeek | 166/342 |
| 5,176,218 | 1/1993 | Singer et al. | 166/206 |

OTHER PUBLICATIONS

Cooper Oil Tool publication entitled *Tension Integral Tie--Back System*; (2 pg.); Oct. 1979.

Cooper Oil Tool publication entitled *Innovations*; (10 pg.); Oct. 1984.

*Primary Examiner*—Frank S. Tsay

*Attorney, Agent, or Firm*—Conley, Rose & Tayon

[57] ABSTRACT

A string of tubular members is suspended in tension from a surface wellhead by suspending the string from a hanger within a bore in the wellhead; supposing a support member on the wellhead; moving the support member into engagement with the hanger; inserting at least one support shoulder on the support member into an annular recess in the hanger; and supporting the tubular members in tension from the support member.

18 Claims, 8 Drawing Sheets

HANGER ASSEMBLY

BACKGROUND OF THE INVENTION

The present invention relates to an oilfield hanger and wellhead system and more particularly to a hanger assembly for suspending a tubular string in tension from a surface wellhead on an offshore platform.

Offshore drilling and production systems include a subsea wellhead system or mud line suspension system for supporting concentric tubular pipe strings such as casing and tubing strings into the borehole of an offshore well. A drilling platform is located at the water's surface such as on a jack up rig, a floating rig, or a tension leg platform, as for example. Risers or tie-back casing strings extend from the mud line suspension system to a surface wellhead system located at the drilling platform to tie the sub sea wellhead with the surface wellhead. The riser or tie-back casing string engages a hanger at the mud line at its lower end and is suspended by another casing hanger at its upper end at the surface wellhead. Typically the outer casing string is a drilling riser which includes one or more concentric tie-back casing strings suspended therewithin. One or more production tubing strings are ultimately suspended within the concentric casing strings.

The surface wellhead includes a high pressure housing for supporting casing and tubing strings and controlling downhole pressure. An annulus is formed between the outer drilling riser and the inner tie-back casing string and attachments may be provided on the housing to control the annulus pressure if required. The surface wellhead includes metal-to-metal seals to prevent leakage and provides backup seals spaced from the metal-to-metal seals to monitor leakage through monitoring ports.

It is desirable that the casing and tubing strings are suspended in tension. A floating platform will heave due to the swells and waves of the water, thus raising and lowering the elevation of the platform. Further, the heat generated by the flow of hydrocarbons through the inner production tubing string will cause linear expansion of the outer casing strings which might otherwise make them buckle due to the induced expansion and contraction.

The outer drilling riser may include a pipe section adjacent to its upper end with outer grooves for engagement with and connection to a hydraulic lift mounted on the drilling platform. One type of hydraulic lift includes a rocker arm which has a connector at its terminal end with a plurality of teeth for mating engagement with the grooves on the upper pipe section of the drilling riser. The grooved pipe section is several feet long to avoid a precise alignment of certain grooves with the teeth of the hydraulic lift. Once the rocker arm is attached to the grooved pipe section, the drilling riser is placed in tension by hydraulically actuating the rocker arm to elevate the drilling riser.

Tie-back casing strings and production tubing strings are suspended within the outer drilling riser. These strings are suspended in tension by a surface hanger. For example, tie-back casing strings are connected at their lower ends to other casing strings at the mud line which are suspended within the borehole by the mud line suspension system. The majority of the load of the casing string suspended into the borehole is supported at the ocean floor by a conventional subsea wellhead. The tie-back casing string at the surface wellhead may support a portion of the casing load at the sub sea wellhead as well as the weight of the tie-back casing string. Current applications in 3,000 feet of water using seven inch, 32 pounds per foot casing, will generate approximately 7,500 per inch of linear stretch measured at the surface. This assumes that the total landed surface load exceeds the cumulative weight of the tie-back casing string extending between the surface wellhead and the subsea wellhead. These factors combined with installation limits in controlling the measured space-out, dictate that the surface hanger for the tie-back casing string have the ability to accommodate some variation in the final landed elevation of the surface hanger. Thus, a variable position style surface hanger is required due to the inability to accurately measure and space-out the tie-back casing string between the subsea wellhead and the surface wellhead. This difficulty in spacing out long tie-back casing strings requires that the surface hanger be able to adjust up or down a substantial distance, such as, for example, up to four feet.

Different methods have been employed to suspend a tubular string in tension from the surface wellhead. One method is to adjust the surface hanger up or down to achieve proper tensioning and then cut the hanger or tubular pipe to the proper length. Another method is to make the surface wellhead large enough to receive the entire surface hanger and pack off. This works well for small adjustments, such as 2 to 4 inches, but not when an adjustment of a matter of feet is required. Still another method is to move the entire wellhead up or down as necessary, but this is very expensive and requires the drilling rig to have unlimited height capability causing this method to be ineffective.

A slip hanger may be used to support the string in tension at the surface wellhead. Upon the string being held in tension, slips, in the form of arcuate wedges, are disposed between the pipe string and the surface wellhead. The slips include threaded surfaces which bite into the outer cylindrical surface of the tubular pipe. The slip hangers allow the use of a predetermined tension on the string since they bite into the pipe at any elevation to achieve the desired tension. However, certain problems may arise in the use of a slip hanger. The use of a slip hanger is a time consuming operation. Further, slip hangers are imprecise in the amount of tension maintained since slippage can occur as the slips are installed. Further, in tension leg platforms, there is greater heave of the platform caused by the water and also there is more stretch in the pipe string particularly at greater water depths. In such situations, the biting and indenting of the slips into the outer surface of the pipe enhances the fatigue factor of the pipe due to the substantial dynamic load caused by the constant wave action and heave of the platform.

U.S. Pat. No. 4,938,289 discloses a surface wellhead which includes a hanger assembly having a hanger threaded to an annular support sleeve for suspending a casing string in tension. An upward force is applied to the casing string to tension and stretch the casing, thereby raising the upper end of the casing above a landing shoulder. When the desired tension has been applied, an actuator sleeve, engaging the annular support sleeve, is rotated causing the annular support sleeve on the hanger to rotate and move downwardly on its threaded connection with the hanger until the annular support sleeve lands on the landing shoulder of the wellhead. The applied tension from the casing string is then released with the tension being maintained by the engagement of the annular support sleeve on the landing shoulder.

Another type of conventional tie-back apparatus is the tension integral tie-back system of Cooper Industries, Inc. which includes a two-piece tie-back sub that is installed in the casing string just below the surface hanger. When the surface hanger is landed, a forging tool is run on drill pipe and positioned into the tie-back sub. Once the forging tool is installed, a set of lifting segments is mechanically engaged into prepared slots and tension is applied. While this tension is being maintained on the tie-back string, hydraulic pressure is applied to the forging tool, producing a downward thrust on a tapered plug within the forging tool. This plug engages forging dies forcing them out to deform an inner sleeve into a pre-machined profile in the outer sleeve of the sub.

The hanger assembly of the present invention overcomes the deficiencies of the prior art and provides for varying the landing position of the hanger and installing a pack off to isolate the pressures above and below the connection.

SUMMARY OF THE INVENTION

The hanger assembly of the present invention includes a plurality of arcuate segments pinned by shear pins to a support ring disposed on the landing shoulder of a surface wellhead. The arcuate segments include inwardly directed arcuate teeth. A lock ring is disposed on top of the arcuate segments. A piston sleeve is received within the bore of the surface wellhead and supported by the arcuate segments to form an annular cylinder in which is disposed an annular actuator piston. The piston sleeve is positioned to retain the arcuate segments in their non-engaged position. A hydraulic port extends through the wall of the wellhead to the cylinder above the piston.

A mandrel type tubular pipe hanger is disposed within the bore of the wellhead and suspends a pipe string extending to the mud line. The pipe hanger is supported by the draw works on the drilling platform. The hanger includes a plurality of annular grooves spaced along its axial length. Upon the hanger being supported at a particular elevation to achieve a predetermined tension on the pipe string, the cylinder is pressurized through the hydraulic port causing the piston sleeve to move upwardly and release the arcuate segments. Upon release of the arcuate segments, the actuator piston moves downwardly with the lock ring to move the arcuate segments down a tapered camming surface formed by the support ring and a taper on the landing shoulder within the wellhead. The downward movement of the actuator piston causes the arcuate segments to cam radially inward into engagement with the hanger.

If the arcuate teeth on the arcuate segments are not aligned so as to be received by a set of the annular grooves on the hanger, the hanger is raised or lowered by the draw works to align the hanger grooves with the arcuate teeth on the segments. By monitoring the pressure within the cylinder, it can be determined whether the arcuate teeth on the arcuate segments have been received within a set of the annular grooves in the hanger. Upon the supporting engagement of the hanger by the arcuate segments, the lock ring moves further downwardly behind the arcuate segments to lock them in their radial inward and engaged position.

The upper portion of the surface wellhead is then removed and the hanger is cut to length. The piston sleeve and actuator piston are removed and replaced with a pack-off sleeve carrying seals for sealing the annulus formed by the pipe string and drilling riser. An actuator nut threadingly engages the wellhead to actuate the seals and hold the pack-off sleeve and seals in position. The upper portion of the wellhead is then reconnected.

Other objects and advantages of the invention will appear from the following description.

BRIEF DESCRIPTION OF THE DRAWINGS

For a detailed description of the preferred embodiment of the invention, reference will now be made to the accompanying drawings wherein.

DETAILED DESCRIPTION OF THE PREFERRED EMBODIMENTS

Figure 1:
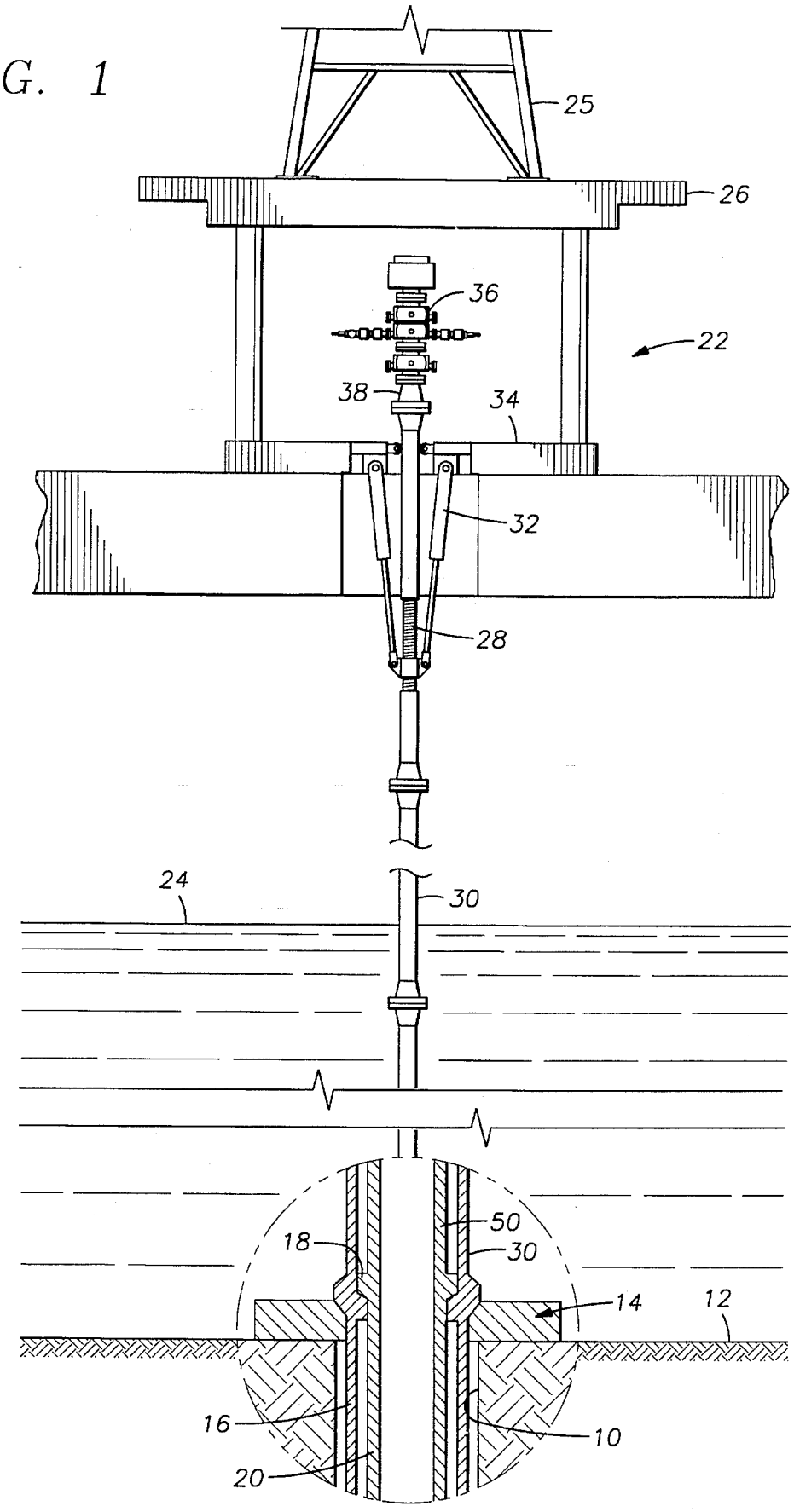
FIG. 1 is a schematic view with a portion thereof enlarged, of an offshore production platform having a surface wellhead of the present invention.

Referring initially to FIG. 1, a wellbore 10 extends downwardly through the sea bed at the ocean floor. A mud line suspension system 14 is located at the mud line 12 and supports a plurality of hangers suspending concentric casing strings and production tubing strings into the borehole 10. For example, a 9⅝ inch outer casing string 16 may be supported by a hanger in mud line suspension system 14 with an inner casing string 20 supported by a hanger 18 inside of outer casing string 16. Although not shown, one or more production tubing strings may be suspended within an inner casing string at the mud line suspension system 14.

The drilling operations for drilling the borehole 10 occur from a drilling platform 22 located at the water's surface 24. Although the drilling platform 22 may be either supported at the mud line 12 or may be a floating platform, the present invention is particularly directed to a floating platform such as a floating drilling rig or a tension leg platform. For purposes of illustration and not by way of limitation, the present invention will be described with respect to a tension leg platform such as that shown and described in Paper No. OTC 7535 entitled *The Seastar Tension—Leg Platform* by J. E. Kibbee et al, May 1994 Offshore Technology Conference, Houston, Tex., and Paper No. OTC 7218 entitled *Snorre Marine Operations* by J. I. Knudsen et at, May 1993 Offshore Technology Conference, Houston, Tex., both incorporated herein by reference.

FIG. 1 illustrates a tension leg platform 22 which floats on the water surface 24 by means of a plurality of buoyancy tanks such as caissons (not shown) affixed to the comers of the platform 22. The tension leg platform 22 includes a drilling floor 26 on which is mounted a draw works 25. A drilling riser 30 is shown extending from the platform 22 to the mud line suspension system 14 at the mud line 12. The drilling riser 30 is typically 9⅝ inch casing and may include a grooved pipe section 28, having a length of 8 to 10 feet, to which is attached a drilling riser tensioner 32 for maintaining drilling riser 30 in tension. The drilling riser 30 is attached at its lower end to mud line suspension equipment 14 and extends to a surface wellhead 38 on the rig base 34. A BOP stack 36 is mounted on surface wellhead 38. The distance between the mud line 12 and the platform 22 may be several thousand feet such as 3,000 feet. In any given surface completion, the exact distance between the surface wellhead 38 and the mud line suspension system 14 is not known with precision. Typically, the distance is known within a few feet.

It should be appreciated that the hanger assembly of the present invention may be used to suspend any oilfield tubular member in tension. For example, the hanger assembly may be used to suspend a drilling riser, casing string, or production string from the surface wellhead. The tubular member may be any type of pipe such as casing or tubing. By way of example and not by limitation, the embodiments of the present invention are described using the hanger assembly of the present invention to suspend a casing string in tension from a surface wellhead.

Drilling operations are conducted through drilling riser 30. A tie-back casing string 50 is connected to hanger 18 for lowering hanger 18 and lower casing string 20 from platform 22 into borehole 10. For 9⅝ inch drilling riser, a typical tie-back casing string would be 7 inch casing. Hanger 18 is landed on a support shoulder within mud line suspension system 14 for supporting lower casing string 20 within borehole 10. Hanger 18, in turn, suspends lower casing string 20 several thousand feet, such as 8,000 feet, into wellbore 10. Mud line hanger 18 may be locked into position within the mud line suspension system 14. Typically, however, mud line hanger 18 is not fixed within mud line suspension equipment 14 when the water is at great depth such as 3,000 feet. The annulus formed by lower casing string 20 and the outer casing string 16 is cemented by flowing cement down through the casing string 50 and up the annulus to a point just below mud line suspension system 14. Ultimately, a string of production tubing is suspended within fie-back casing string 50 and lower casing string 20.

Tie-back casing string 50 extends from mud line suspension system 14 at its lower end to the surface wellhead 38 at its upper end on platform 22. It is preferred that casing string 50 be completely in tension between mud line suspension system 14 and surface wellhead 38. Oftentimes casing string 50 also supports a portion of the weight of lower casing string 20. For example, if the mud line suspension system 14 suspends lower casing string 20 approximately 8,000 feet into borehole 10, the mud line suspension system 14 would support approximately 800,000 pounds. This load may be reduced by having casing string 50 support, for example, 300,000 pounds of that load thereby reducing the load supported by the mud line suspension system 14 to 500,000 pounds.

Further, by keeping casing string 50 in tension, no bends are created in casing string 50 as platform 22 is raised or lowered by the water. Thus, the tension on casing string 50 will increase and decrease with the heave of platform 22. This increase and decrease of tension is to be kept within an acceptable range. For example, the fluctuation of the tension of casing string 50 may be in the range of between 50,000 and 200,000 pounds due to wave action. The particular range of tension for casing string 50 will vary with the particular well. Also, the tension range is determined by the particular design of the tension leg platform 22 and the kind of tensioners used on the platform. Water depth is also a factor. Thus, the particular range of desired tension on casing string 50 will depend upon many factors related to the particular well and platform being utilized.

Figure 2:
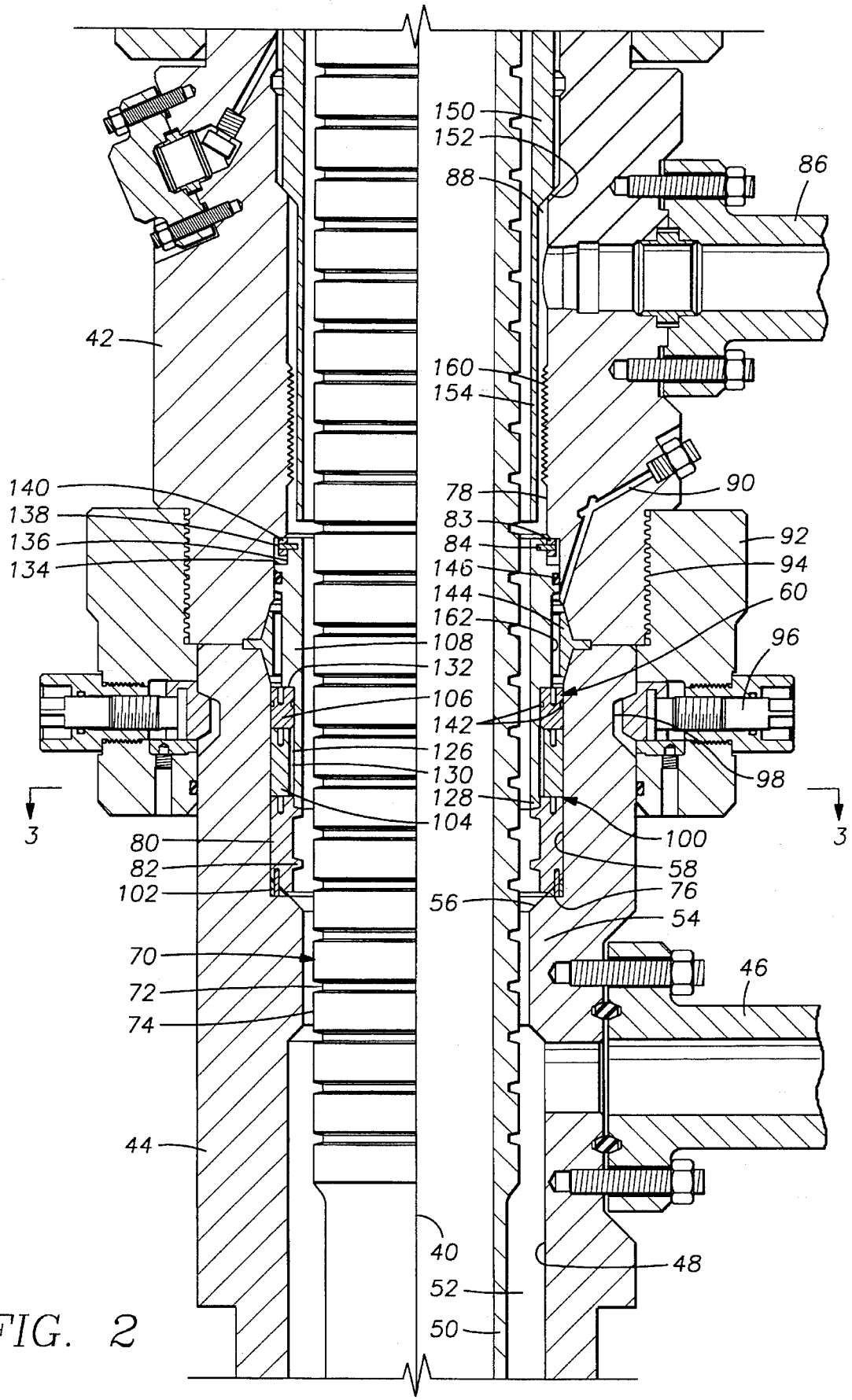
FIG. 2 is a side elevation view in cross-section of the surface wellhead of the present invention shown in the non-engaged position.

Referring now to FIG. 2, the hanger assembly 60 of the present invention suspends inner casing string 50 on surface wellhead 38 within a predetermined acceptable range of tension. It is preferred that the hanger assembly 60 support casing string 50 within a window of adjustment, as for example, plus or minus 7,000 to 15,000 pounds of the desired tension. To suspend string 50 within the acceptable range of the desired tension, the elevation of casing string 50 may be varied up to forty-eight inches.

The surface wellhead 38 includes an upper wellhead 42 and a lower wellhead 44. Lower wellhead 44 is in the form of a tensioner joint which is welded at its lower end to grooved pipe section 28. Lower wellhead 44 includes an annulus valve 46 which communicates with the annulus 52 formed by casing string 50 and drilling riser 30 and also includes a bore 48 with a restricted annular portion 54 projecting radially inward into bore 48. Restricted annular portion 54 has an upwardly facing, downwardly and inwardly tapering, frusto-conical shoulder 56. Bore 48 is enlarged above restricted annular portion 54 forming a counterbore 58. Counterbore 58 forms an upwardly facing annular shoulder 76 adjacent to frusto-conical shoulder 56. Frusto-conical shoulder 56 has a 45° taper with the flow axis 40 and annular shoulder 76 is perpendicular to the flow axis 40.

Upper wellhead 42 includes an annular bore 78 with an enlarged diameter counterbore 84 adjacent its lower terminal end thereby forming a downwardly facing annular stop shoulder 83. A hydraulic fluid port 90 extends through the wall of upper wellhead 42 communicating counterbore 84 with the exterior of upper wellhead 42 for actuating hanger assembly 60 as hereinafter described in further detail. Upper wellhead 42 also includes an annulus valve 86 for communicating with the annulus 88.

A fast lock connection 92 is threaded at 94 to the lower end of upper wellhead 42 and provides a quick means for connecting upper wellhead 42 to lower wellhead 44. Fast lock connection 92 includes a plurality of lock down dogs 96 which are received by an annular groove 98 in lower wellhead 44 so as to attach upper wellhead 42 to lower wellhead 44. An annular metal ring gasket 144 is disposed between opposed frusto-conical surfaces on upper and lower wellheads 42, 44 to provide a metal-to-metal sealing engagement therebetween.

Hanger assembly 60 includes a mandrel style hanger 70 disposed at the upper end of casing string 50 and a support and locking mechanism 100 for supporting and locking the hanger 70 within surface wellhead 38. Support and locking mechanism 100 also includes a support ring 102, a lock ring 104, an actuator piston 106, and a cylinder piston sleeve 108. Hanger 70 has a machined outer diameter which approximates that of standard couplings and an inner diameter common to that of casing string 50. Hanger 70 may be manufactured in any practical length to accommodate the required space-out requirements and preferably has a length of four feet.

Figure 2A:
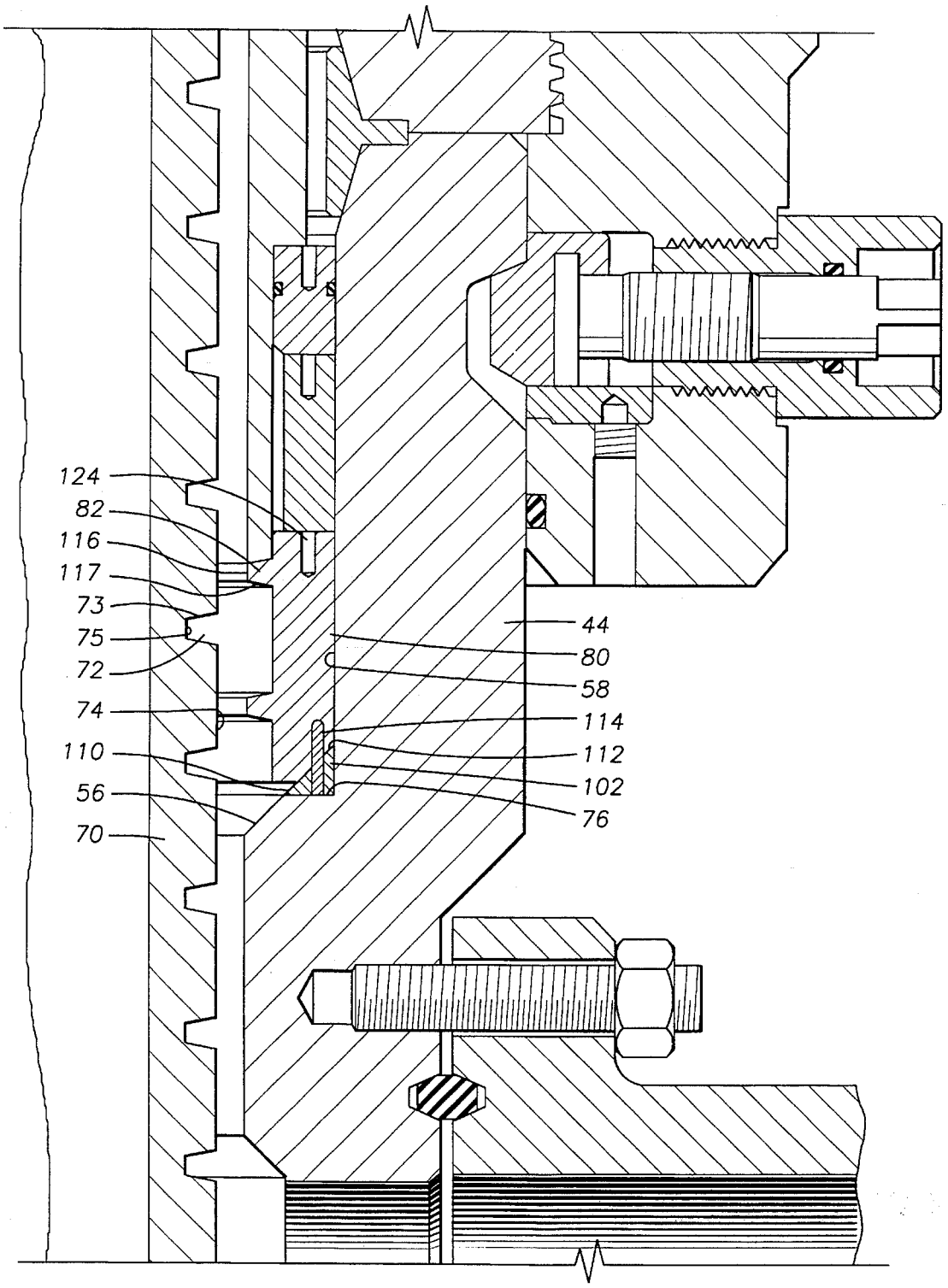
FIG. 2A is an enlarged cross-sectional view of the arcuate segments and support ring shown in FIG. 2.

Referring now to FIG. 2A, support and locking mechanism 100 includes a plurality of locking arcuate segments 80 having a plurality of arcuate rings or teeth 82 which are directed radially inward. Arcuate segments 80 preferably include at least two inwardly directed arcuate teeth 82. Arcuate teeth 82 include a profile with a crest 116 and tapered flanks 117.

The outer surface of hanger 70 includes multiple, circular recesses or grooves 72 evenly spaced along the axial length of the mandrel forming hanger 70. Grooves 72 are adapted to receive the inwardly projecting arcuate teeth 82 of segments 80. Annular sealing surfaces or lands 74 are formed between adjacent grooves 72. Grooves 72 have tapering flanks 73 and a root 75. The tapering flanks 73 on grooves 72 provide ease of insertion of arcuate tings 82 upon a slight axial misalignment. The tapering flanks 73 also provide a better locking engagement with arcuate teeth 82. Further, there is less of a stress concentration if the tapered flanks 73 are other than perpendicular. The preferred angle of the tapering flanks 73 is approximately 15° to 20°.

Support ring 102 is a continuous ting and has a cross section which forms an isosceles triangle with a vertical side, horizontal side, and a tapered side 112. In the installed position, the annular horizontal side is supported by upwardly facing annular shoulder 76 on lower wellhead 44 and the annular vertical side is slidingly received within counterbore 58 of lower wellhead 44. Upwardly facing tapered side 112 preferably includes a 45 degree taper which mates with the preferred 45 degree taper on frusto-conical shoulder 56. Tapered side 112 and frusto-conical shoulder 56 form a ramp 110 for camming arcuate segments 80 into engagement with hanger 70.

Arcuate segments 80 are azimuthally spaced around annular support ring 102. The number of segments 80 depends upon the diameter of the particular casing string 50 being suspended by the hanger assembly 60. There are preferred 8 segments 80 for a seven inch casing string. Segments 80 are held in place by a series of shear pins 114 which extend through aligned bores in support ring 102 and segments 80. Shear pins 114 hold arcuate segments 80 in place and prevent segments 80 from falling into the borehole 10. The number of arcuate teeth 82 is determined by the bearing capacity required for the applicable loads. Teeth 82 may be two to eight in number. Tapped bores 124 are provided in the upper terminal end of segments 80 to receive threaded installation rods (not shown) for installing segments 80 and support ring 102 in counterbore 58.

Figure 3A:
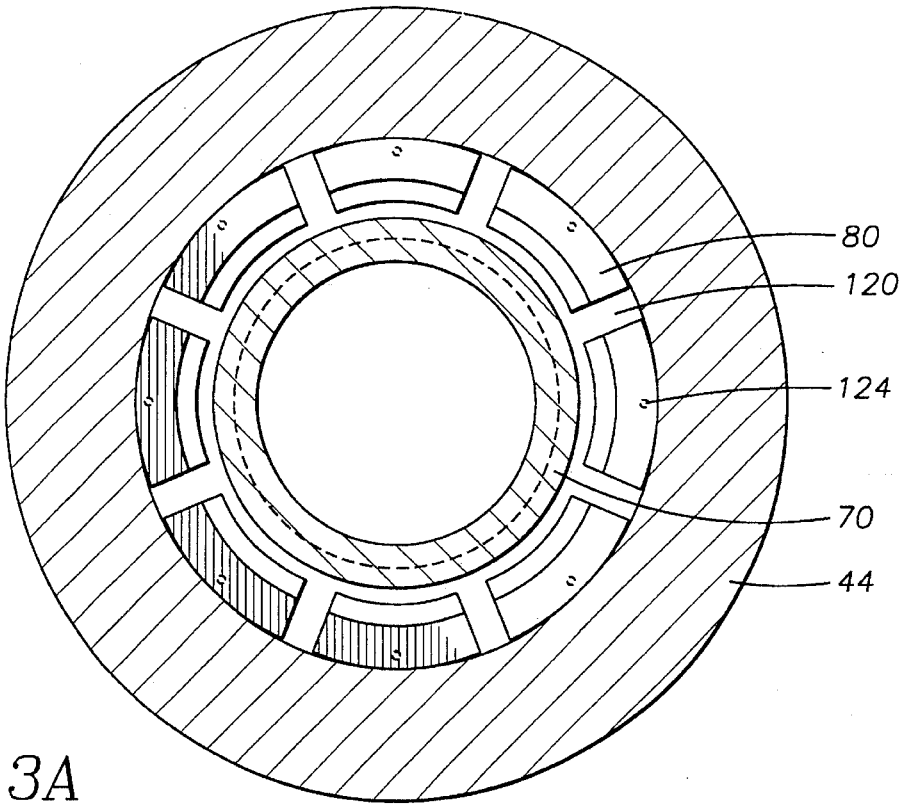
FIG. 3A is a cross-sectional view at plane 3—3 in FIG. 2 showing the arcuate segments of the surface wellhead in the retracted position.
Figure 3B:
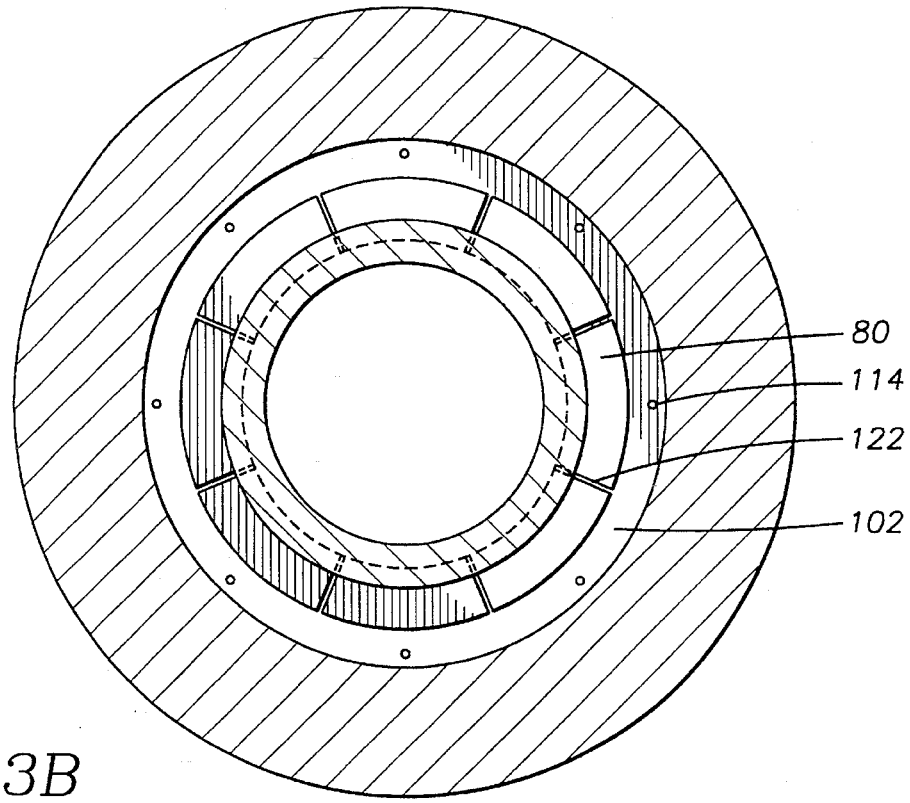
FIG. 3B is a cross-sectional view at plane 3—3 shown in FIG. 2 with the arcuate segments of the surface wellhead system shown in the engaged position.

Referring now to FIGS. 3A and 3B, FIG. 3A illustrates arcuate segments 80 mounted on support ring 102 in their radial outer and non-engaged position. In their radial outer and non-engaged position, gaps 120 separate adjacent segments 80. FIG. 3B illustrates arcuate segments 80 in their radial inner and engaged position. Clearances 122 are provided between adjacent segments 80 to ensure that adjacent segments do not engage upon actuation. Premature engagement between adjacent segments 80 could prevent arcuate teeth 82 from being fully inserted into grooves 72.

Referring again to FIG. 2, lock ring 104 is a continuous ring disposed on top of arcuate segments 80. Locking ring 104 also includes threaded installation bores in its upper end for receiving installation rods (not shown). Upon segments 80 moving to their radial inward and engaged position, lock ring 104 will move downwardly within counterbore 58 so as to be positioned between the backside of segments 80 and the cylindrical wall forming counterbore 58 thereby locking and preventing segments 80 from backing out of grooves 72.

Piston sleeve 108 is reciprocably disposed within the counterbores 58, 84 of upper and lower wellheads 44, 42, respectively. Piston sleeve 108 includes a lower reduced outer diameter portion 126 forming an annular cylinder 130 with the cylindrical wall of counterbore 58. The lower terminal end 128 of piston sleeve 108 rests on the upper tapered flank side 117 of the upper arcuate tooth 82 of segments 80 and engages the inner circumferential surface of segments 80, thus retaining arcuate segments 80 in their outer radial and non-engaged position as shown in FIG. 2. It can be seen that segments 80 cannot be moved radially inward so as to engage hanger 70 until piston sleeve 108 moves upwardly within wellhead 38.

The reduced outer diameter portion 126 forms a downwardly facing piston shoulder 132 which is adjacent to the upper side of annular piston 106 in the non-engaged position. The upper end of piston sleeve 108 also includes a reduced outer diameter portion 134 forming an upwardly facing annular shoulder 136 and an annular boss housing a seal ring 146 which sealingly engages the wall of counterbore 84 of upper wellhead 42 above the outlet of hydraulic fluid port 90. A retainer ring 140 is mounted around the upper terminal end of piston sleeve 108 and is pinned thereto by shear pins 138. Retainer ring 140 prevents piston sleeve 108 from prematurely moving upwardly and releasing segments 80.

Annular actuator piston 106 is disposed in annular cylinder 130 above lock ring 104. Annular piston 106 is sized to apply the necessary force on segments 80 to shear pins 114 and drive segments 80 into engagement with hanger 70. Actuator piston 106 also includes threaded installation bores in its upper end for threadingly receiving installation rods (not shown). Piston 106 includes inner and outer annular seal tings 142 for sealingly engaging the wall of counterbore 58 and the wall of reduced outer diameter portion 126. Annular seal rings 142 prevent the passage of fluid upon actuation of piston 106 via fluid port 90.

A wear bushing 150 is received in bore 78 and is supported on an annular shoulder 152 in upper wellhead 42. Wear bushing 150 includes a cylindrical skirt 154 which extends downwardly to a point above the upper terminal end of piston sleeve 108. Upper wellhead 42 includes an inwardly projecting threaded portion 160 adapted for engagement with an actuator nut 190, hereinafter described with respect to FIG. 4. Wear bushing 150 protects threads 160 and the inner surfaces forming bore 78 of upper wellhead 42.

Having lowered the casing string 50 into outer drilling riser 30 and having landed hanger 18 in mud line suspension system 14, the casing string 50 projects, at that time, above the blowout preventer stack 36. A rotary connection (not shown) is attached to the top of hanger 70 and is connected to elevators on the draw works of the drilling rig 25. The elevators on the draw works place a tension load on casing string 50 which is measured by a gauge on the draw works. When the tension reaches the predetermined tension to be placed on string 50, the support and locking mechanism 100 of hanger assembly 60 is activated.

FIG. 2 illustrates the hanger assembly 60 in the non-engaged position prior to the actuation of the support and locking mechanism 100. To actuate mechanism 100, hydraulic pressure is applied through pressure port 90 to the cylinder 130 between piston shoulder 136 and actuator piston 106. The force on piston shoulder 136 causes the upward movement of piston sleeve 108 shearing shear pins 138 and allowing piston sleeve 108 to move upwardly into contact with stop shoulder 83. The upper terminal end of piston sleeve 108 is received within bore 78 of upper wellhead 42. This upward movement of piston sleeve 108 releases arcuate segments 80.

Upon releasing arcuate segments 80, the fluid pressure applies a downward force on the upper side of annular actuator piston 106 causing arcuate segments 80 to travel downwardly and radially inward thereby shearing shear pins 114. Upon the radial inward movement of segments 80, lock ring 104 is permitted to move downwardly behind segments 80 if teeth 82 are aligned with grooves 72.

Shear pins 138 are sized to shear prior to shear pins 114. The relative shearing force dictates the sequence of which pins are sheared first. For example, shear pins 138 might shear at 200 psi while shear pins 114 might shear at 400 psi. The number and size of the shear pins will determine the pressure force required for shearing.

It is most probable that upon the inward and downward movement of arcuate segments 80, the arcuate teeth 82 will not be in alignment with a set of grooves 72 on hanger 70. Also, lock ring 104 will not be able to move behind segments 80 because segments 80 have not been fully received within grooves 72 of mandrel hanger 70. If segments 80 are not in alignment with grooves 72, it is necessary to use the draw works to move hanger 70 up or down to align teeth 82 with grooves 72. Since lands 74 are two inches in height, it may be necessary to move hanger 70 up or down as much as two inches. A two inch change in elevation changes the tension on casing string 50 by 15,000 pounds. Thus, to the extent of this change in elevation, the final tension will vary from the desired tension. However, if the elevation of the hanger 70 is changed to the closest set of aligned grooves 72, then the hanger 70 need only be moved a maximum of one inch up or down which is only about 7,500 pounds difference from the desired tension.

Upon arcuate segments 80 engaging mating grooves 72, lock ring 104 is driven downward by applying fluid pressure into the cylinder 130 thus locking arcuate segments 80 into grooves 72 of hanger 70. All of the casing weight is then set in the wellhead 38 by releasing the hanger 70 from the draw works.

Because there is a fixed volume in cylinder 130, the fluid pressure being applied through port 90 can be monitored at a pressure gauge so as to determine the particular position of the individual parts of the support and locking mechanism 100. By monitoring pressure port 90, the operator can determine when arcuate segments 80 are properly secured within grooves 72 and when lock ring 104 has been set behind segments 80.

Upon segments 80 fully engaging hanger 70 and hanger 70 being suspended on segments 80, upper wellhead 42 is disconnected from lower wellhead 44 to allow access to hanger 70. The hanger 70 is then machined off at its proper height, approximately seven inches above the upper face of lower wellhead 44. The well is controlled by the column of drilling fluids in the casing string 50. This type of well control is common and is used in installing prior art slip hangers in a surface wellhead. The wear sleeve 150, piston sleeve 108 and actuator piston 106 are then removed from wellhead 38.

Figure 4:
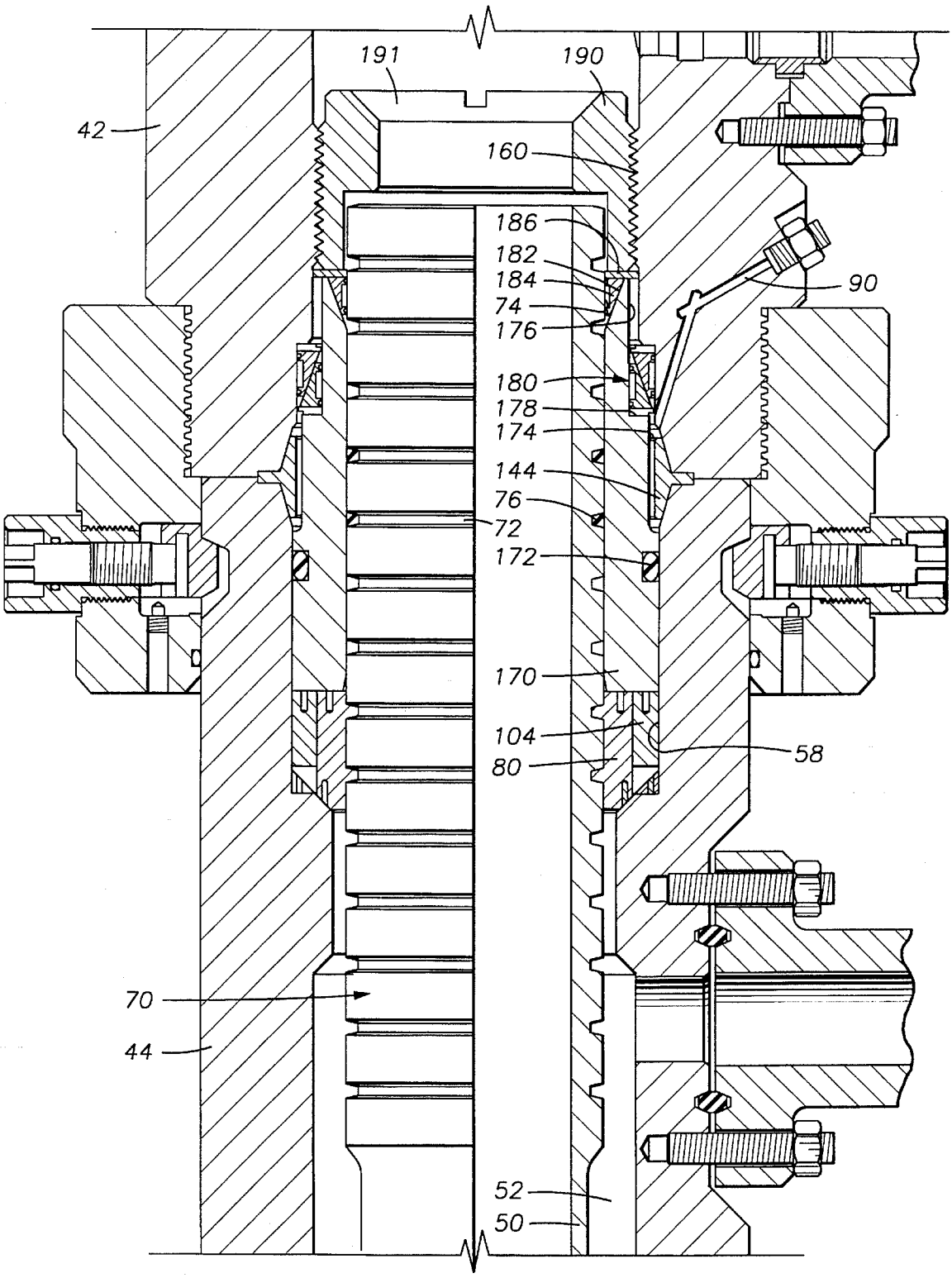
FIG. 4 is a side elevation view in cross-section of the surface wellhead of the present invention shown in the engaged position.

Referring now to FIG. 4, elastomeric seals 76 are placed in a set of the upper grooves 72 of hanger 70 and isolate the pressures in annulus 52. The particular set of upper grooves 72 in which are disposed elastomeric seals 76 will be dependent upon the elevation of hanger 70 within lower wellhead 44. Seals 76 provide sealing redundancy to the inside of lower wellhead 44. A special seal may be molded to conform with grooves 72 to serve as seal 76. Further, seals 76 could also include garter springs on each side thereof to prevent extrusion.

A pack-off sleeve 170 is installed over the upper neck of hanger 70 with the lower terminal end of sleeve 170 engaging the top of segments 80 and lock ring 104. Sleeve 170 includes an outer groove, housing an elastomeric seal 172 for sealingly engaging the wall of counterbore 58. Seal 172 is an interference seal and provides a seal below ring gasket 144. Sleeve 170 also includes a reduced diameter portion 174 for receiving metal gasket 144. Sleeve 170 includes a further reduced diameter upper end 176 forming an upwardly facing annular shoulder 178.

A CANH seal 180 is received over the upper terminal end 176 of sleeve 170 and supported by annular shoulder 178. CANH seals are described in U.S. Pat. No. 4,556,224, incorporated herein by reference. Metal bearing rings are provided above and below the CANH seals 180 to allow retrieval of the seals. CANH seal 180 is preloaded to withstand any pressures which will occur in the annulus 52 but may be any appropriate seal which will withstand the anticipated annulus pressure. Seal 172 and CANH seal 180 allow pressure testing of ring gasket 144 to make sure there is no leakage between upper and lower wellheads 42, 44. CANH seal 180 also prevents fluid from coming up the flow bore of casing string 50 and passing around the upper end to possibly leak around ring gasket 144 to the exterior of wellhead 38.

The interior upper end of sleeve 170 is beveled at 182 for receiving a seal 184. A thrust ring 186 is installed above seal 184 for actuating half CANH seal 184 downwardly so as to sealingly engage land 74 of hanger 70. Hanger 70 extends as high as it does within wellhead 38 so that a sealing surface can be provided for seal 184.

The height of the land 74 between grooves 72 on hanger 70 is approximately two inches. This height is dictated by the type of seal used for sealing the hanger 70. The half CANH seal 184, located near the upper end of hanger 70, is a metal-to-metal seal which engages land 74 and therefore the height of land 74 must accommodate that sealing engagement. If a shorter seal were used in place of the half CANH seal 184, grooves 72 could be placed closer together.

A lock down nut 190 is lowered into the bore of upper wellhead 42 and includes exterior threads for threading engagement with interior threads 160 on upper wellhead 42. A torque tool (not shown) engages the lock down nut 190 for threading nut 190 onto threads 160 on upper wellhead 42. Lock down nut 190 generates a downward thrust on bearing ring 186 and energizes half CANH seal. 184 until thrust ring 186, acting as a bearing ring, engages the upper terminal end of sleeve 170 thereby effecting a positive lock down of the hanger assembly 60. Ring 186 also prevents nut 190 from rotating seal 184. Nut 190 further provides a bit guide 191 for running tools through the flow bore of casing string 50.

The upper wellhead 42 is then reinstalled onto lower wellhead 44. Fluid pressure is applied through port 90 to ensure seal integrity. Pressure is continuously monitored through port 90 to ensure there is no leakage past the seals.

Figure 5:
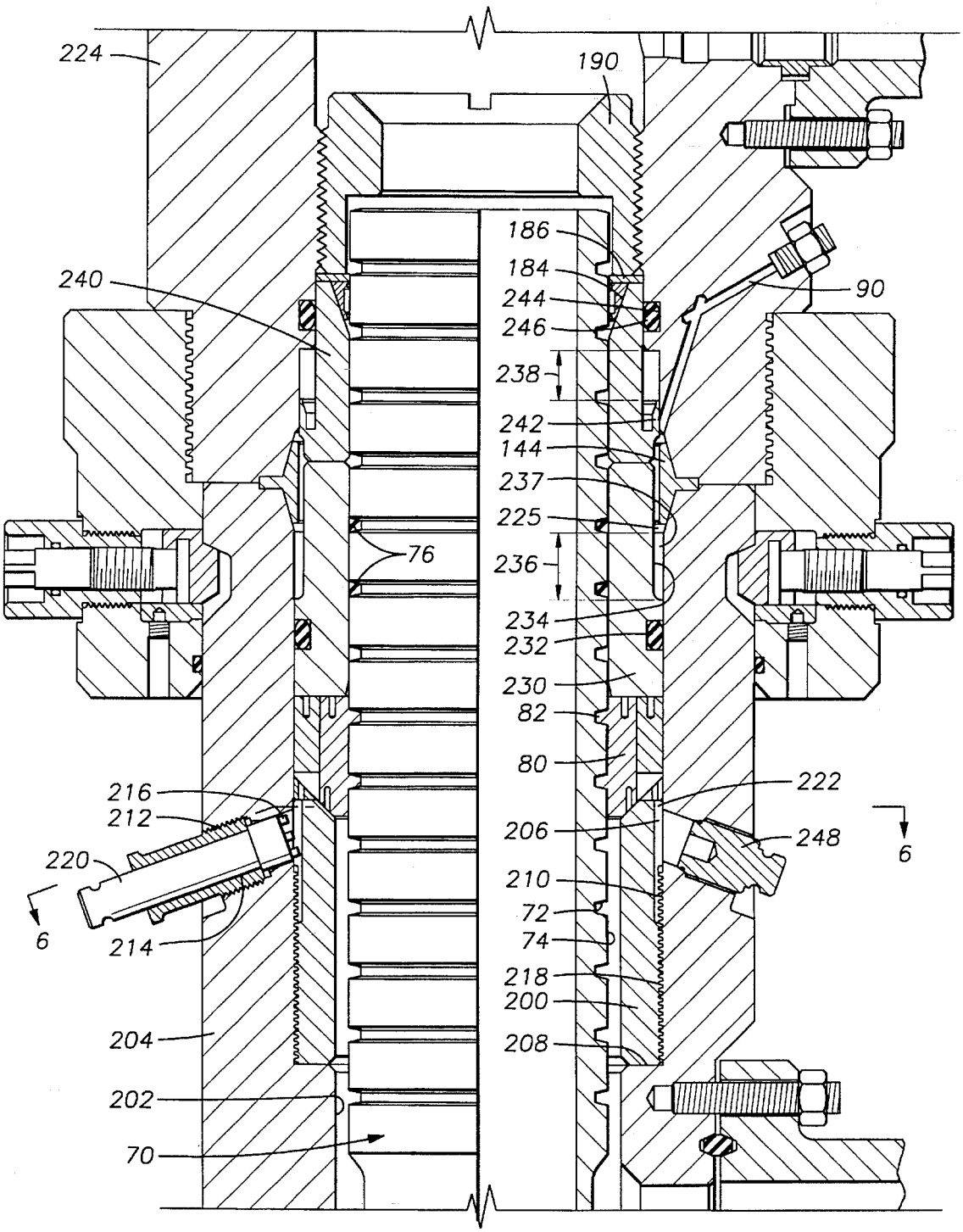
FIG. 5 is a side elevation view in cross-section of an alternative embodiment of the hanger assembly of the present invention.
Figure 6:
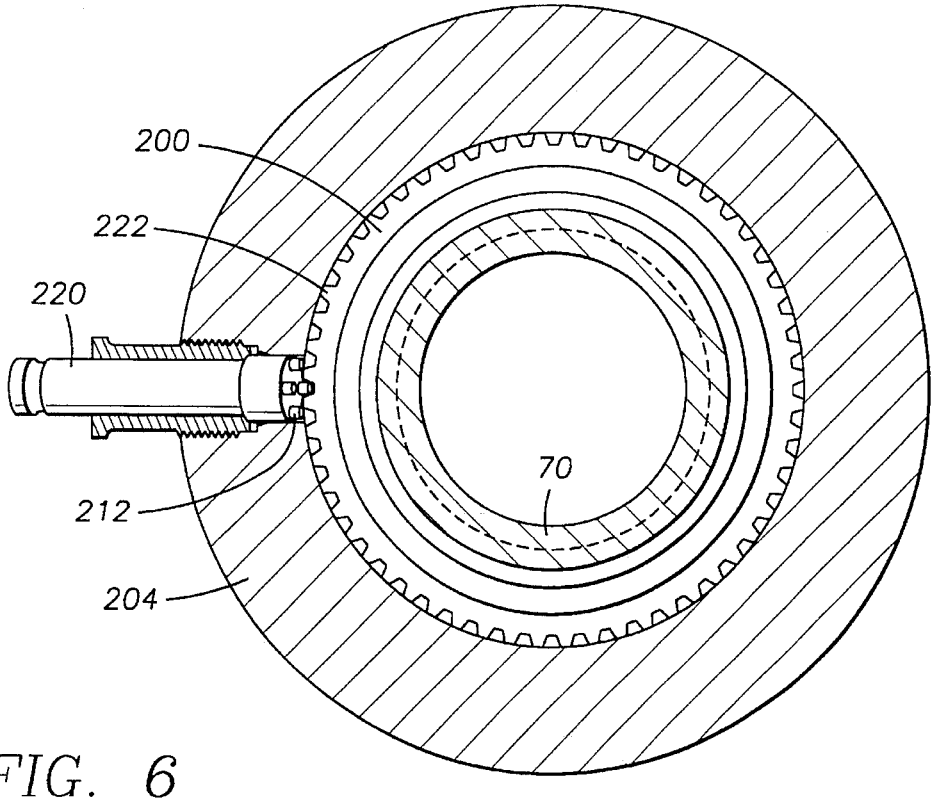
FIG. 6 is a cross-sectional view at plane 6—6 shown in FIG. 5 illustrating the torque tool in engagement with the splines of the support ring of the present invention.

Referring now to FIGS. 5 and 6, there is shown an alternative embodiment of the present invention. This embodiment provides a movable load shoulder 200 disposed in bore 202 of lower wellhead 204 to provide an infinite adjustment of the elevation of segments 80 with respect to hanger 70. In this embodiment, hanger 70 is set at an elevation which directly correlates with the desired tension for casing string 50. The preferred embodiment requires that the casing string 50 be suspended at an elevation within a two inch range. Movable load shoulder 200 is an adjustable elevation support for hanger 70 and replaces the need to add or remove applied surface load to hanger 70 to align grooves 72 with arcuate teeth 82. Thus, the alternative embodiment allows a closer adjustment of elevation than was previously allowed in the preferred embodiment.

Lower wellhead 204 includes a counterbore 206 forming an upwardly facing annular shoulder 208. A plurality of threaded apertures 212 are provided through the wall of lower wellhead 204 and extend upwardly at an angle into counterbore 206 just above the upper thread of threads 210. A threaded gland 214 is threaded into at least two of the apertures 212. A beveled gear type torque tool 220 is rotatably mounted within gland 214. Tool 220 includes a plurality of fingers 216 projecting from its inner terminal end. The number of fingers 216 on tool 220 may vary from four to eight. Preferably, there are eight fingers. Other means may be used to externally move movable load shoulder 200.

Movable load shoulder 200 is generally cylindrical having lower exterior threads 218 for threading engagement with threads 210 of lower wellhead 204. The upper end of movable load shoulder 200 includes a plurality of splines 222 azimuthally spaced around its outer circumference. Splines 222 include slots therebetween for receiving at least one of the fingers 216 on tool 220. As can be appreciated, rotation of beveled gear type torque tool 220 causes fingers 216 to engage and bear on splines 222 so as to rotate movable load shoulder 200 on threads 210 acting like a type of screw. Rotation of the beveled gear tool 220 causes the movable load shoulder 200 to rotate within counterbore 206 of lower wellhead 204 on threads 210, thus causing load shoulder 200 to travel upward or downward within lower wellhead 204 until the arcuate segments 80 are aligned with a set of grooves 72. All of the load of the mandrel hanger 70 is taken in the threads of movable load shoulder 200.

A sleeve 230 is mounted within counterbore 206 and includes an outer groove which receives an elastomeric seal ring 232. Seal ring 232 sealingly engages the inner wall forming counterbore 206. Elastomeric rings 76 mounted on hanger 70 sealingly engage the inner cylindrical surface of sleeve 230. A reduced diameter portion 234 is provided on the upper outer surface of sleeve 230 to accommodate metal gasket 144.

A pack-off sleeve 240 is mounted above sleeve 230 and includes a radially energized, metal lip seal 242 adapted for sealing engagement with the inner wall of upper wellhead 224. Metal lip seal 242 is an interference seal having a radially outward angle prior to installation. It is radially engaged upon installation. This seal replaces the CANH seal 180 of the preferred embodiment. The CANH seal 180 is engaged by axial compression which is inappropriate in the alternative embodiment due to the necessary axial adjustment. A half CANH seal 184 and thrust washer 186 are disposed above sleeve 240 with nut 190 holding the pack-off sleeve 240 and seals in place.

An inner annular groove 244 is provided on upper wellhead 224 for housing elastomeric seal 246 which sealingly engages the outer surface of sleeve 240. Seals 76, 184, 246 and 232 allow fluid pressure port 90 to test the integrity of metal gasket 144.

For the movable load shoulder 200 to be completely adjustable, space must be provided at each of the seal regions to accommodate the movement of shoulder 200. The thread height of threads 210, the height 236 of the portion 234 of sleeve 230, and the clearance 238 above lip seal 242 must all be greater than the height of land 74 between adjacent grooves 72 on hanger 70. In the case of the preferred embodiment, the required height would be at least two inches.

In operation, with the segments 80 in their non-engaged position, the casing string 50 is supported by the draw works. The draw works places a tension on casing string 50 until the indicator gauge shows the predetermined tension force on string 50. Once the predetermined tension is attained, pressure is applied through port 90 to actuate segments 80. Assuming no immediate alignment of teeth 82 with grooves 72, arcuate teeth 82 contact the lands 74 of mandrel hanger 70. Torque tool 220 is then rotated within gland 214 to rotate movable load shoulder 200 on threads 210. Movable load shoulder 200 typically is in the upper position since it is easier to move shoulder 200 downwardly because of the fluid pressure in annular area 225. Having engaged arcuate segments 80 with hanger 70, glands 214 are removed and apertures 212 are plugged by plugs 248.

Figure 8:
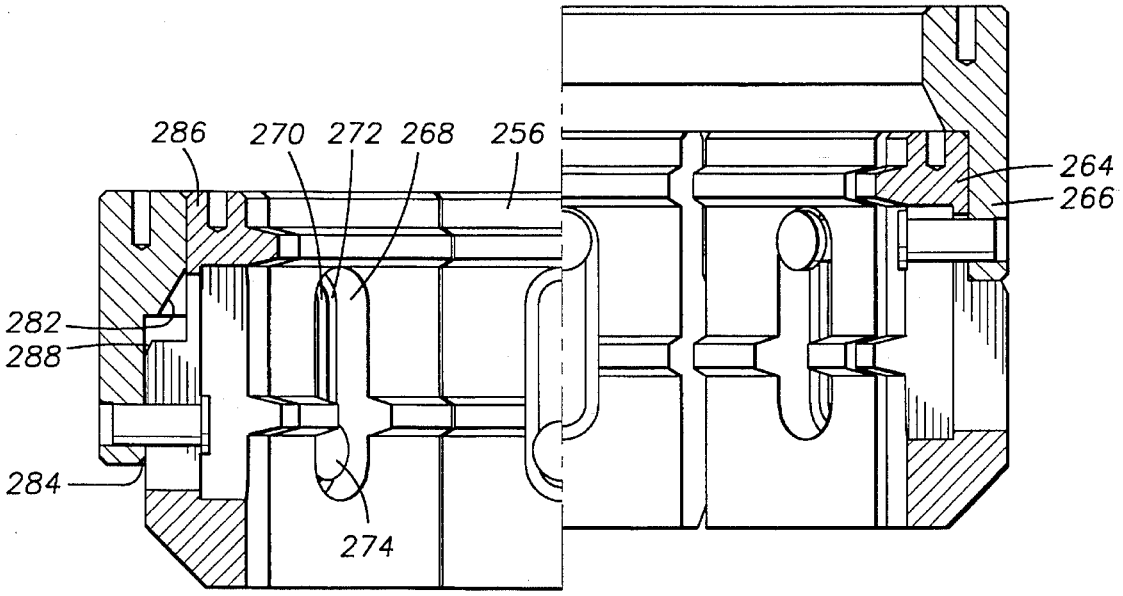
FIG. 8 is a side elevation view in cross-section of the support and locking mechanism of FIG. 7 with the right half of the Figure illustrating the arcuate segments in the non-engaged position and the left half of the Figure illustrating the arcuate segments in the engaged position.
Figure 7:
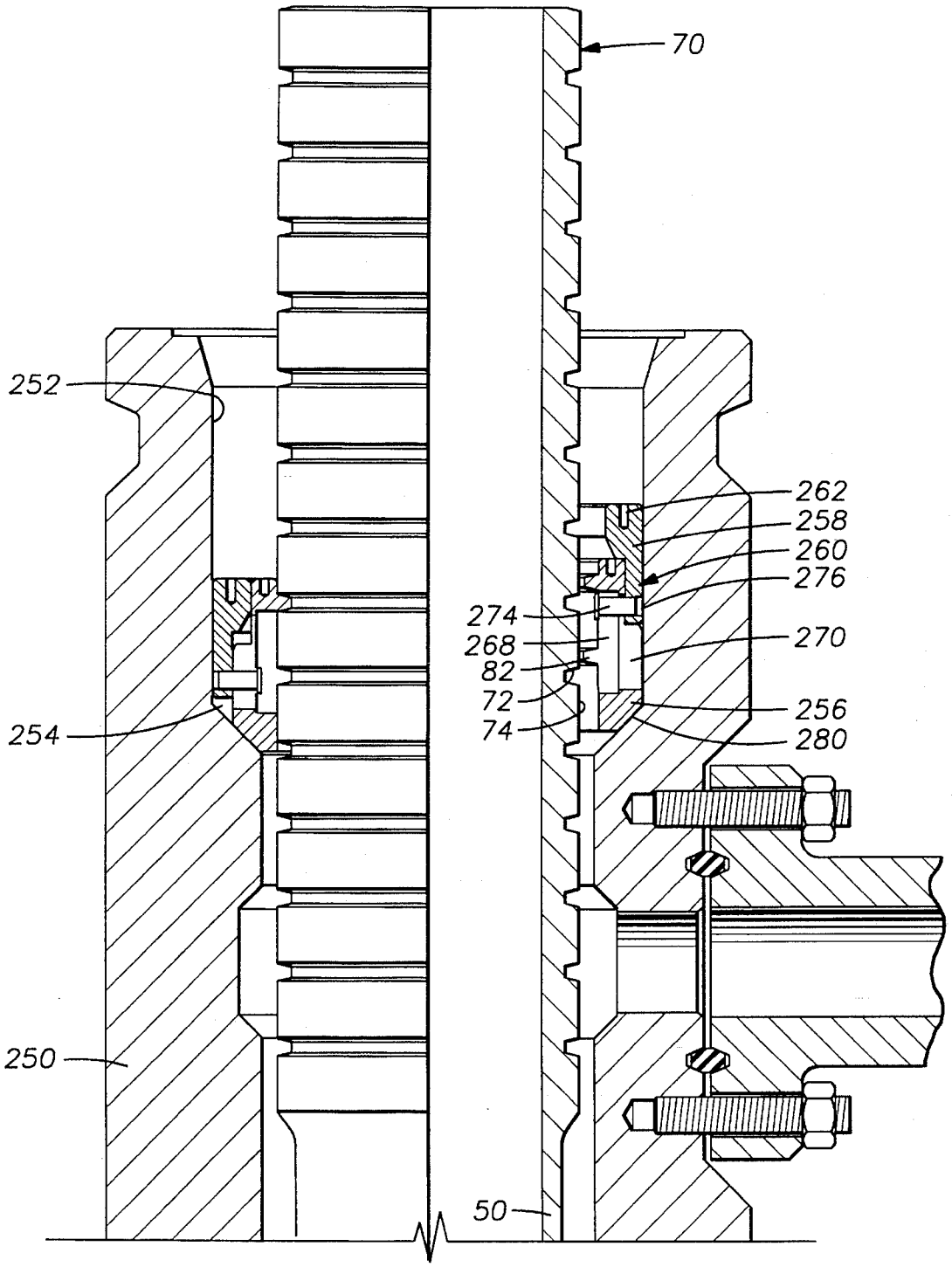
FIG. 7 is a side elevation view in cross-section of a further alternative embodiment of the hanger assembly of the present invention with the right half of the Figure showing the arcuate segments in the non-engaged position and the left half of the Figure showing the arcuate segments in the engaged position.

Referring now to FIGS. 7 and 8, there is shown a further alternative embodiment of the present invention with the right half of the Figures showing the segments in the non-engaged position and the left half of the Figures showing the segments in the engaged position. This embodiment allows for the manual installation of the segments and lock ring of the present invention. A lower wellhead 250 includes a counterbore 252 forming an upwardly facing, downwardly and inwardly tapering landing shoulder 254. Hanger 70 is shown projecting through counterbore 252.

The support and locking mechanism 260 of the alternative embodiment includes a plurality of arcuate locking segments 256 mounted on a lock ring 258 comprised of two C-shaped halves. A plurality of threaded bores 262 are disposed in the upper terminal end of lock ring 258 to receive threaded installation rods (not shown) for lowering the mechanism 260 into counterbore 252.

Each of the halves of lock ring 258 supports four arcuate segments 256. Arcuate segments 256 and lock ring 258 include inner and outer reduced diameter portions 264, 266, respectively, for the nesting of the inner portion 264 of arcuate segments 256 within outer portion 266 of lock ring 258. Each arcuate segment 256 further includes an inner and outer milled slot 268, 270, respectively, with outer slot 270 having a smaller width than that of inner slot 268. A shoulder 272, facing radially inward, is formed by the change in width of slots 268, 270. Each arcuate segment 256 is mounted on lock ring 258 by a threaded retainer member 274 which has a shaft sized to pass through outer narrow slot 270 and a head sized to be received within inner wider slot 268 but not through outer narrow slot 270. The end of the shaft of member 266 is threaded to threadingly engage a threaded bore 276 in lock ring 258.

Each arcuate segment 256 includes a downwardly facing, downwardly and inwardly tapering lower surface 280 for mating, camming engagement with landing shoulder 254. Lock ring 258 further includes annular chamfered surfaces 282, 284 for camming engagement with arcuate chamfered surfaces 286, 288 respectively, of arcuate segments 256.

In operation, an upper wellhead and fast lock connection, substantially identical to upper wellhead 42 and fast lock connection 92 shown in FIG. 2 without hydraulic port 90, is removed from lower wellhead 250. Casing string 50 is lowered through the bore of the upper wellhead and the bore and counterbore 252 of lower wellhead 250 until hanger 18 is landed on the mud line suspension system 14. The draw works then places casing string 50 in tension. The upper wellhead is then removed to allow access to counterbore 252.

The two halves of lock ring 258, together with the supported arcuate segments 256, are lowered into counterbore 252 on installation rods (not shown) threaded into threaded bores 262 in lock ring 258. The arcuate segments 256 are lowered in their outer non-engaged position as shown on the right half of FIGS. 7 and 8. The head of retainer member 274 projects from inner, wider slot 262. Upon the tapered surface 280 of arcuate segments 256 engaging tapered landing shoulder 254 on lower wellhead 250, arcuate segments 256 begin their downward and radially inward movement within counterbore 252. The two halves of lock ring 258 are driven downwardly causing arcuate segments 256 to move inwardly into engagement with hanger 70. The chamfered surfaces 282, 286 and 284, 288 of segments 256 and lock ring 258 assist in driving and camming arcuate segments 256 downwardly and inwardly. As arcuate segments 256 move radially inward, the head of retainer member 274 is received within inner larger slot 268. The head of member 274 does not prematurely engage shoulder 272 so as to prevent arcuate teeth 82 from being fully received within grooves 72 of hanger 70. The halves of lock ring 258 continue to be driven downwardly and behind arcuate segments 256 so as to maintain arcuate segments 256 in their radial inward and engaged position.

Once arcuate segments 256 are in the engaged position, a pack-off sleeve and seals, such as shown and described with respect to FIG. 4, are then installed within counterbore 252. The upper wellhead is then re-connected on lower wellhead 250 and a locking nut threaded into the bore of the upper wellhead to actuate the seals into sealing engagement and maintain mechanism 260 in the engaged position. By eliminating the pressure actuation of the preferred embodiment, the height of lower wellhead 250 is reduced thereby reducing the envelope of counterbore 252.

It should be appreciated that other means may be used to actuate arcuate segments 80. For example, arcuate segments 80 may be mounted on threaded actuation screws which extend through the wall of lower wellhead 44. The screws are then actuated by rotation to move arcuate segments 80 radially inward. It is generally preferred, however, that the number of bores through the wall of wellhead 38 be kept to a minimum. The greater the number of apertures through wellhead 38, the greater the likelihood of a leak.

It should also be appreciated that arcuate segments 80 may be in the form of a split ring. The split ring may include a hinged portion opposite the opening in the ring and may be mounted on support shoulder 76 in the expanded position. Upon actuation, the split ring would be contracted to engage the grooves 72 around mandrel hanger 70. One advantage of a split ring is the certainty that it will not fall into borehole 10.

While a preferred embodiment of the invention has been shown and described, modifications thereof can be made by one skilled in the art without departing from the spirit of the invention.

I claim:

1. A method of suspending a string of tubular members in tension from a wellhead comprising the steps of:

suspending the tubular members in tension from a hanger within a bore in the wellhead;

supporting a support member on the wellhead;

moving the support member toward the hanger;

inserting at least one support shoulder on the support member into an annular recess in the hanger; and supporting the tubular members in tension from the support member.

2. The method of claim 1 further including the step of applying a force to move the support member into engagement with the hanger.

3. The method of claim 2 wherein the step of applying force includes applying pressure to move the support member and further including the step of monitoring the pressure to determine whether the support shoulder of the support member has been inserted into an annular recess.

4. The method of claim 1 further including the step of locking the support member into engagement with the hanger.

5. The method of claim 1 wherein the step of moving the support member includes camming the support member into engagement with the hanger.

6. The method of claim 1 further including the steps of retaining the support member in a non-engaged position and releasing the support member upon actuating the support member into engagement with the hanger.

7. The method of claim 1 wherein the step of supporting the support member includes supporting the support member, having a plurality of arcuate segments, on a support ring supported by the wellhead.

8. The method of claim 1 further including the steps of cutting the excess length of the hanger and sealing the annulus between the tubular members and wellhead.

9. The method of claim 1 further including the step of aligning the support shoulder with the annular recess.

10. The method of claim 9 wherein the step of aligning includes moving the support member to align the support shoulder with the annular recess.

11. An apparatus for suspending a string of tubular members in tension comprising:

a wellhead having a support surface projecting into a bore in said wellhead;

a mandrel disposed within said bore for suspending the tubular members, said mandrel having a plurality of axially spaced annular recesses;

a support member movably disposed on said support surface from a non-engaged position with said mandrel to an engaged position with said mandrel;

said support member having at least one support shoulder, said support shoulder being received within one of said annular recesses in said engaged position for supporting said mandrel within said wellhead; and an actuator member for moving said support member from said non-engaged position to said engaged position.

12. The apparatus of claim 11 wherein said actuator member is disposed within a cylinder formed on said wellhead, said cylinder being adapted for connection to a fluid pressure source for actuating said actuator member.

13. The apparatus of claim 12 further including a piston retaining said support member in said non-engaged position, said piston releasing said support member upon pressurizing said cylinder to actuate said actuator member.

14. The apparatus of claim 13 wherein said piston is releasably disposed within said wellhead by a first shear member and said support member is releasably disposed within said wellhead by a second shear member, said first shear member shearing before said second shear member upon the application of fluid pressure.

15. The apparatus of claim 11 wherein said support member includes a plurality of arcuate segments releasably disposed on a support ring.

16. The apparatus of claim 15 wherein said support ring and support surface form a camming surface for camming said support member into said engaged position.

17. The apparatus of claim 11 further including a lock member for locking said support member in said engaged position.

18. The apparatus of claim 11 further including an alignment member for aligning said support shoulder with said annular recess.

* * * * *